US006135099A

United States Patent [19]

Marrs et al.

[11] Patent Number: 6,135,099

[45] Date of Patent: Oct. 24, 2000

[54] IGNITION SYSTEM FOR AN INTERNAL COMBUSTION ENGINE

[75] Inventors: Thomas C. Marrs, 425 State Rd. 25 North, P.O. Box 909, Rochester, Ind. 46975; Barry Green, Rochester, Ind.

[73] Assignee: Thomas C. Marrs, Rochester, Ind.

[21] Appl. No.: 09/258,776

[22] Filed: Feb. 26, 1999

[51] Int. Cl.[7] ..... F02P 3/00

[52] U.S. Cl. ..... 123/606

[58] Field of Search ..... 123/606, 607, 123/635

[56] References Cited

U.S. PATENT DOCUMENTS

| | | | |
|---|---|---|---|
| 2,462,491 | 2/1949 | Hallett . | |
| 2,485,241 | 10/1949 | Lang . | |
| 2,675,415 | 4/1954 | Cushman . | |
| 2,840,622 | 6/1958 | Marden . | |
| 3,048,704 | 8/1962 | Estes . | |
| 3,542,006 | 11/1970 | Dusenberry et al. . | |
| 3,749,973 | 7/1973 | Canup | 123/606 |
| 3,861,369 | 1/1975 | Canup | 123/606 |
| 3,906,919 | 9/1975 | Asik et al. | 123/606 |
| 3,926,557 | 12/1975 | Callies et al. | 123/606 |
| 4,327,701 | 5/1982 | Gerry | 123/607 |
| 4,398,526 | 8/1983 | Hamai et al. | 123/606 |
| 4,522,185 | 6/1985 | Nguyen | 123/606 |
| 4,710,681 | 12/1987 | Zivkovich . | |
| 4,875,457 | 10/1989 | Fitzner . | |
| 4,998,526 | 3/1991 | Gokhale . | |
| 5,181,498 | 1/1993 | Koiwa et al. . | |
| 5,359,981 | 11/1994 | Kim . | |
| 5,537,983 | 7/1996 | Nakajima | 123/635 |
| 5,615,659 | 4/1997 | Morita et al. . | |
| 5,628,298 | 5/1997 | Murata | 123/635 |

*Primary Examiner*—Erick Solis
*Attorney, Agent, or Firm*—Harrison & Egbert

[57] ABSTRACT

An ignition system for an internal combustion engine having a transformer with a primary winding adapted to be connected to a power supply and a second winding adapted to be connected to a spark plug of the internal combustion engine, and a controller interconnected to the transformer so as to activate and deactivate the output of the transformer. The transformer serves to produce an output from the secondary winding having a frequency of between 1 KHz and 100 KHz and a voltage of at least 20 kilovolts. In particular, the transformer produces an output of an alternating current having a high voltage sine wave reaching at least 20 kilovolts. A voltage regulator is connected to the power supply and to the transformer so as to provide a constant DC voltage input to the transformer. The transformer produces power of constant wattage from the output of the secondary winding during the activation by the controller. The transformer is connected to the spark plug and to the controller so as to produce an arc of controllable duration across an electrode of the spark plug. This duration is selected from between 0.5 milliseconds and 4.0 milliseconds. A battery is the power supply which is connected to the primary winding of the transformer. This battery produces a variable voltage of between 5 and 15 volts.

29 Claims, 3 Drawing Sheets

IGNITION SYSTEM FOR AN INTERNAL COMBUSTION ENGINE

TECHNICAL FIELD

The present invention relates to internal combustion engines. More particularly, the present invention relates to electrical ignition apparatus which are used for the igniting of fuel within the internal combustion engine. More particularly, the present invention relates to ignition coils which apply an AC current for the ignition of the spark plug within the internal combustion engine.

BACKGROUND ART

Most internal combustion engines have some type of an ignition circuit to generate a spark in the cylinder. The spark causes combustion of the fuel in the cylinder to drive the piston and the attached crankshaft. Typically, the engine includes a plurality of permanent magnets mounted on the flywheel of the engine and a charge coil mounted on the engine housing in the vicinity of the flywheel. As the flywheel rotates, the magnets pass the charge coil. A voltage is thereby generated on the charge coil and this voltage is used to charge a high voltage capacitor. The high voltage charge on the capacitor is released to the ignition coil by way of a triggering circuit so as to cause a high voltage, short duration electrical spark to cross the spark gap of the spark plug and ignite the fuel in the cylinder. This type of ignition is called a capacitive discharge ignition.

The design of standard reciprocating internal combustion engines which use spark plugs and ignition coils to initiate combustion have, for years, utilized combustion chamber shapes and spark plug placements which were heavily influenced by the need to reliably initiate combustion using only a single short-duration spark of relatively low intensity. In recent years, however, increased emphasis has been placed on fuel efficiency, completeness of combustion, exhaust cleanliness, and reduced variability in cycle-to-cycle combustion. This emphasis has meant that the shape of the combustion chamber must be modified and the ratio of the fuel-air mixture changed. In some cases, a procedure has been used which deliberately introduces strong turbulence or a rotary flow to the fuel-air mixture at the area where the spark plug electrodes are placed. This often causes an interruption or "blowing out" of the arc. This has placed increasing demands on the effectiveness of the combustion initiation process. It has been found highly preferable, in such applications, to have available an arc which may be sustained for as much as 4 to 5 milliseconds. Efforts to effectuate this idea have resulted in various innovations identified in several patents.

For example, U.S. Pat. No. 5,806,504, issued on Sep. 15, 1998 to French et al., teaches an ignition circuit for an internal combustion engine in which the ignition circuit includes a transformer having a secondary winding for generating a spark and having first and second primary windings. A capacitor is connected to the first primary winding to provide a high energy capacitive discharge voltage to the transformer. A voltage generator is connected to the second primary winding for generating an alternating current voltage. A control circuit is connected to the capacitor and to the voltage generator for providing control signals to discharge the high energy capacitive discharge voltage to the first primary winding and for providing control signals to the voltage generator so as to generate an alternating current voltage.

U.S. Pat. No. 4,998,526, issued on Mar. 12, 1991 to K. P. Gokhale teaches an alternating current ignition system. This system applies alternating current to the electrodes of a spark plug to maintain an arc at the electrodes for a desired period of time. The amplitude of the arc current can be varied. The alternating current is developed by a DC-to-AC inverter that includes a transformer that has a center-tapped primary and a secondary that is connected to the spark plug. An arc is initiated at the spark plug by discharging a capacitor to one of the winding portions at the center-tapped primary. Alternatively, the energy stored in an inductor may be supplied to a primary winding portion to initiate an arc. The ignition system is powered by a controlled current source that receives input power from a source of direct voltage, such as a battery on the motor vehicle.

In each of these prior patents, the devices use dual mechanisms in which a high-energy discharge is supplemented with a low-energy extending mechanism. The method of extending the arc, however, presents problems to the end user. First, the mechanism is, by nature, electronically complex in that multiple control mechanisms must be present either in the form of two separate arc mechanisms or by an arc mechanism and several specialized electronic drivers. Secondly, no method is presented for automatically sustaining the arc under a condition of repeated interruptions. Additionally, these mechanisms do not necessarily provide for a single functional-block unit of low mass and small size which contains all of the necessary functions within.

It is an object of the present invention to provide an ignition system which includes a transformer which is of a small enough size to be mounted directly on the spark plug.

It is a further object of the present invention to provide an ignition system which allows for simple radio frequency shielding so as to prevent radio frequency interference in the electrical system of the vehicle.

It is another object of the present invention to provide an ignition system which delivers constant wattage throughout the entire burn time.

It is still a further object of the present invention to provide an ignition system which enhances the ability to fire cold fuel at startup.

It is a further object of the present invention to provide an ignition system which delivers alternating current to the spark plug so as to greatly reduce spark plug gap erosion.

It is a further object of the present invention to provide an ignition system which provides for an adjustable arc duration on the electrode of the spark plug.

It is still a further object of the present invention to provide an ignition system which can be used consistently and effectively with variable input voltage from the vehicle battery.

It is still a further object of the present invention to provide an ignition system which includes means for sensing the voltage and current at the output of the ignition module for the purpose of assessing conditions within the cylinder.

It is still a further object of the present invention to provide an ignition system which is easy to use, easy to manufacture and relatively inexpensive.

These and other objects and advantages of the present invention will become apparent from a reading of the attached specification and appended claims.

SUMMARY OF THE INVENTION

The present invention is an ignition system for an internal combustion engine that comprises a transformer means having a primary winding adapted to be connected to a power supply and having a secondary winding adapted to be connected to a spark plug. The transformer serves to produce an output from the secondary winding having a frequency of between 1 KHz and 100 KHz and a voltage of at least 20 kilovolts. A controller is connected to the transformer so as to activate and deactivate the output of the transformer means relative to the combustion cycle. The transformer serves to produce the output having an alternating current with a high voltage sine wave reaching at least 20 kilovolts. A voltage regulator is connected to the power supply and to the transformer so as to provide a constant DC voltage input to the transformer. The transformer produces power of constant wattage from the output of the secondary winding during the activation by the controller.

The controller is connected to the transformer so as to allow the transformer to produce an arc of controllable duration across the electrode of the spark plug. Ideally, this duration can be selected from between 0.5 milliseconds and 4 milliseconds. A battery is connected to the primary winding of the transformer. The battery produces a variable voltage of between 5 and 15 volts.

In the present invention, the secondary winding includes an output secondary winding having a connector extending therefrom. This output secondary winding has a current sensor attached thereto and connected to the controller so as to sense current through the output secondary winding. A sensing secondary winding is connected to the controller so as to sense a voltage of the output of the transformer. The transformer includes an inverter for converting the output to an alternating current. In the present invention, the specific inverter which is used is a current-fed Royer-oscillator inverter connected to the primary winding of the transformer.

The voltage regulator in the present invention includes a switch regulator integrated circuit connected to an energy storage inductor and to a switching transistor. The switch regulator integrated circuit receives a variable voltage from the power supply. The switch regulator integrated circuit passes a fixed voltage of between 5 and 50 volts to the transformer. A voltage input is connected to the switch regulator integrated circuit for reducing the fixed voltage with a proportional positive voltage.

In the preferred embodiment of the present invention, the transformer is directly connected onto the spark plug. An electrical line will extend from the transformer to the controller which is mounted at a location away from the spark plug. The battery associated with the internal combustion engine has a power supply line extending to the controller. The controller will pass a fixed voltage from the battery to the transformer. The controller can be in the nature of a microprocessor.

The present invention offers a number of advantages over various prior art systems. The present invention utilizes a very small sized high voltage transformer. This is the result of the high frequency of the operation and the fact that the transformer boosts a relatively high voltage input rather than battery input. The transformer can be small enough to mount directly on top of the spark plug so as to create a package several times smaller and lighter than conventional systems. This further allows for easy radio frequency shielding so as to prevent radio frequency interference in the electrical system, as well as in the radio of the vehicle. The high frequency operation allows for a smaller ferrite core and the high input voltage allows for a smaller turns ratio and consequently fewer turns of wire on the secondary. It is believed that the transformer can utilize a coil which is 1.25 inches in diameter and only 2.5 inches long.

The present invention delivers constant wattage throughout the entire burn time. A normal ignition system fires with maximum wattage in the first 100 microseconds and then exponentially decays to zero. The present invention delivers enough voltage and power to refire an extinguished spark throughout the entire "on" time. This is of great benefit in firing cold fuel at startup (cold starting) when the fuel is not warm enough to fully vaporize.

The present invention utilizes alternating current to the spark plug so as to greatly reduce spark plug gap erosion. Experience has shown that material is removed from the anode and deposited on the cathode, or vice versa, during the operation of normal ignition systems. The removal of material will depend upon the flow direction of the DC current in the spark plug gap. Under certain circumstances, spark plug gaps can erode from 20,000 volt gaps to 35,000 volt gaps over time in conventional systems.

In the present invention, the arc duration is controllably adjustable from between 0.5 milliseconds to 4.0 milliseconds by simply changing the input signal. In actual application, the arc duration can be 4.0 milliseconds during cold starting and reduced to 0.5 milliseconds during normal operation. This can serve to reduce spark plug wear and to reduce the power requirements on the batteries. This adjustment can be done automatically by the controller in relationship to engine temperature or other input variables.

The power boost circuit and the voltage regulator provided in the present invention allows the present invention to operate satisfactorily over a range of 5 volts to 15 volts input. This variable input voltage is the result of the use of conventional automotive batteries.

DETAILED DESCRIPTION OF THE PRESENT INVENTION

Figure 1:
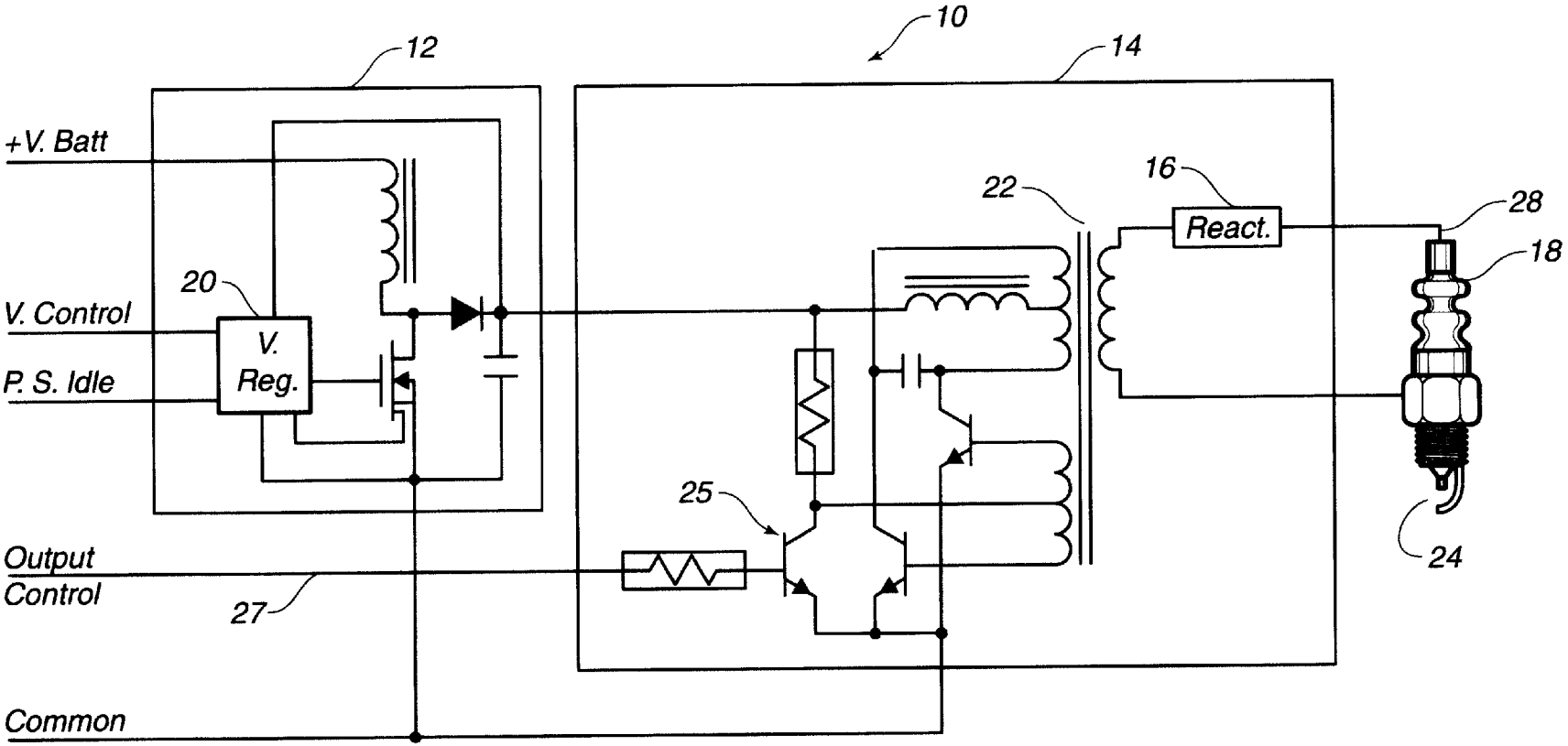
FIG. 1 is a block diagram, with appropriate connections shown, of a first preferred embodiment of the present invention.

Referring to FIG. 1, there is shown at 10 the ignition system in accordance with the preferred embodiment of the present invention. The ignition system 10 includes a pair of functional groups. The first functional group 12 is an input voltage regulator. The second functional group 14 is the output section. The second group 14 produces the high voltage AC output which is current limited by aballasting reactance 16. Functional groups 12 and 14 act together so as to appropriately fire the spark plug 18.

The functional group 12 is the input voltage regulator. Functional group 12 provides a feedback controlled DC supply to the second group 14 so as to permit the deployment of the present invention in engine systems with varying primary DC supply voltages without adjustment. The input voltage regulator 20 may additionally incorporate suitable means to reduce the output voltage when advisable and to go into idle mode to reduce total module current draw from the engine primary DC power supply.

The second functional group 14 produces the high voltage AC output supplied to the spark plug 18. The ballasting reactance can be a lumped-element capacitor, a lumped-element inductor, or a distributed inductance comprised of the leakage inductance of the output transformer 22. In each such case, the intent and effect is to limit output current once an arc has been established across the spark plug electrodes 24 permitting the full output voltage to develop across the electrodes 24 when the open circuit (i.e. no arc) condition occurs. One of the important benefits provided by this action is the property of immediately reestablishing the arc (typically within one-quarter-cycle of the inverter frequency) should it be interrupted by conditions within the combustion chamber. The second functional group 14 also contains a means 25 of controlling the output. This circuit idles the output section when the control input 27 is in the idle state and permits operation when the control input 27 is in the active state. The output control means 25 can also contain circuitry intended to increase ignition timing accuracy.

In the present invention, the second functional group 14 provides a DC-to-AC inverter with high voltage at the output terminal 28 with output current limiting inherent in the characteristics of the circuit. It thus provides for sustaining the arc under all normal conditions and for minimal electrical wear on the spark plug electrodes 24 within the cylinder. The output of the second functional group 14 is set in the lower frequency (RF) band (1 KHz to 100 KHz) for the purposes of rapid electrical action and minimization of size. The present invention, by utilizing high frequencies, can provide low mass, compactness, unitary functionality, and rapid buildup of output voltage at turn-on with high electrical efficiency during sustained arcing. The present invention thus serves both distributor-type ignition systems and coil-near-plug systems, or coil-on-plug systems.

The present invention utilizes a DC to high voltage, high frequency (RF) inverter which is reactively current limited at the output and which contains means by which the inverter may be activated and idled by a low voltage signal, such as is to be expected from an engine controller (whether analog or digital). The present invention also utilizes such controllable inverters with the addition of a power supply whereby DC power to the controllable inverter may be made constant over a specific range of primary supply voltages. The present invention can also include such controllable inverters with regulated power supplies wherein the regulated DC supply to the inverter may be controlled over a specific range of DC output voltages by means of an external control input to the regulated supply. The invention can further comprise such controllable inverters with power supply means providing external control inputs wherein the power supply means may be placed in an idle mode by means of an external control input so as to reduce the power drain from the primary power supply. The present invention also can comprise such controllable inverters with power supply means providing external control inputs for voltage and/or shutdown with timers in the inverter controller circuitry such that time delay in the initiation of the arc due to the time required for the inverter to reach full operation is minimized and/or compensated in order to provide accurate ignition timing to the controlled engine. The present invention can also comprise such controllable inverters with controllable regulated power supplies and timing compensated inverter controllers having additional means whereby the voltage across the output terminals and/or the current through the output terminals may be sensed while the inverter is in operation.

Figure 2:
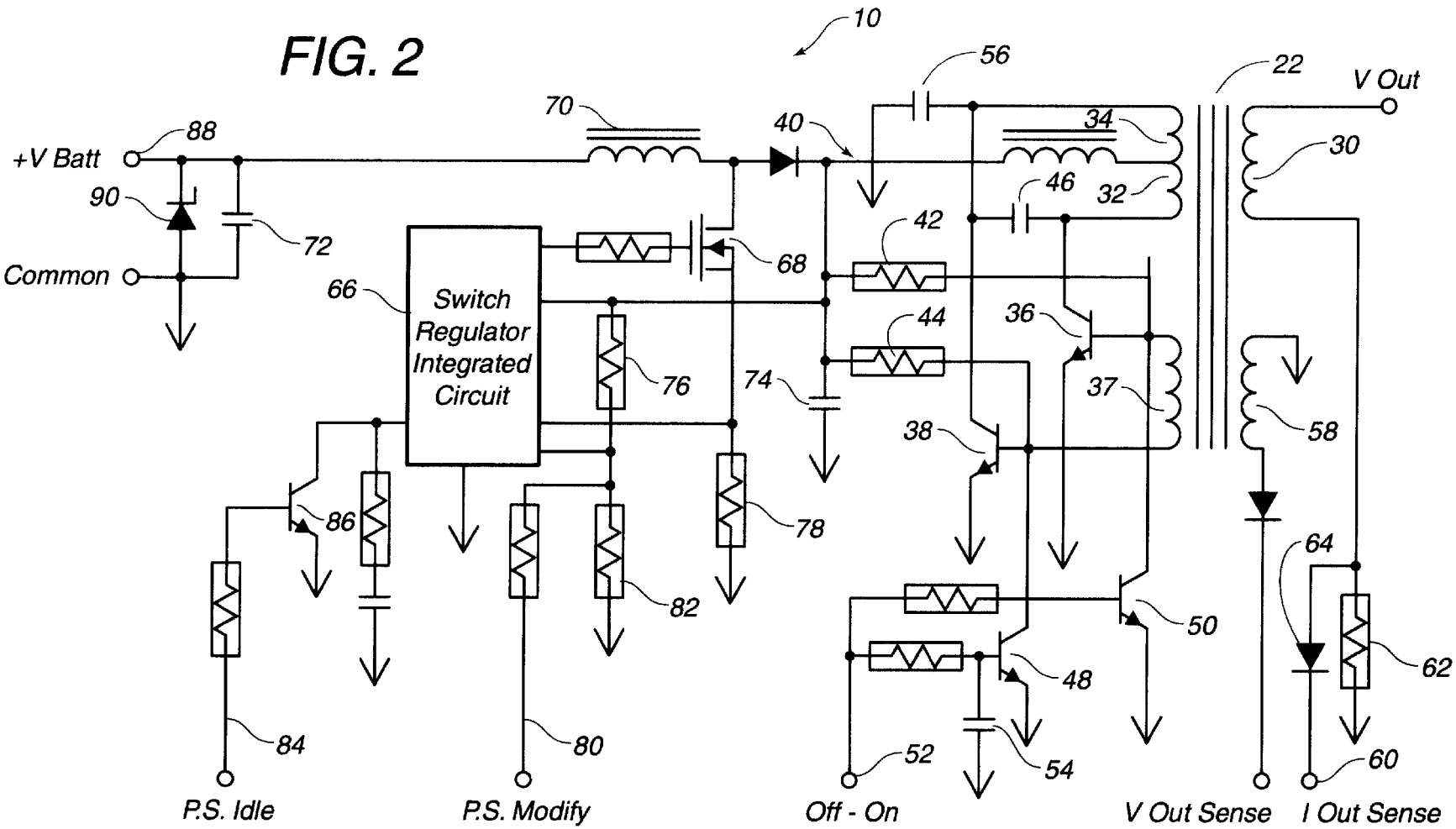
FIG. 2 is a schematic diagram of the preferred embodiment of the present invention showing circuit details.

FIG. 2 is a more detailed view of the schematic of operation of the ignition system 10 of the present invention. It is to be understood that the specific circuit topology shown in FIG. 2, while sufficient to achieve the functionality embodied in the present invention, should not limit, in any way, the scope of the present invention with respect to the specific circuitry, devices or circuit models contained therein. The present invention is, in each of the functions comprising its whole, realizable by way of several different circuit topologies, models and theories of operation. It is further realizable utilizing any of several different makes, models, technologies and types of electronic components in each of the crucial active-device positions in any particular circuit topology chosen to realize a given function. Phrases and terms utilized in the following detailed description are used for descriptive purposes in order to clearly reveal the operation of this preferred embodiment. They should not be construed as limiting the scope of the present invention as claimed herein.

Referring to FIG. 2, the ignition system 10 of the present invention utilizes the output transformer 22. Output transformer 22 can be a gapped magnetic ferrite ceramic core transformer configured so as to provide partial decoupling of the primary and secondary windings. This constitutes the output current limiting reactance 16 in the form of secondary winding 30 leakage inductance. This primary winding 32 has a center tap 34 and switching transistors 36 and 38 connected to each end terminal. A secondary winding 37 is provided for feedback to the control terminals of the switching transducers 36 and 38. A choke is connected between the center tap 34 of primary winding 32 and the regulated power inlet 40. Bias is provided to the switching transducers 36 and 38 from the power inlet 40 through bias resistors 42 and 44. The primary winding 32 is bridged by a resonating capacitor 46 so as to form a resonant tank circuit. This whole forms what is known as a current-fed Royer-oscillator inverter. The oscillator is idled by means of control transistors 48 and 50 which, when turned on by positive voltage on the control terminal 52, pull down the control terminals of switching transistors 36 and 38. The removal of the voltage on control terminal 52 turns off control transistors 48 and 50 so as to permit bias to the switching transistors 36 and 38 and thus permit operation of the inverter. At startup, the oscillator begins to draw current. The resonant tank having the capacitor 46 and the primary winding 32 exhibits a small amount of ringing. The feedback secondary winding 37 is connected so as to provide reinforcing feedback to the switching transistors 36 and 38 so that the ringing is amplified and full amplitude oscillation is reached in one or two cycles of the resonant frequency. Amplitude oscillation will continue, due to the reinforcing feedback, as long as power and bias are available to switching transistors 36 and 38. The inverter circuit is thus self-starting and self-sustaining. Capacitors 54 and 56 may be provided at one or both of the positions shown in FIG. 2 so as to enhance the ringing at turn-on and thus reduce rise time of the inverter. A sensing secondary winding 58 is provided so as to permit feedback to an engine controller unit with respect to the voltage on the output secondary winding 30. The output secondary winding 30 can have its lower terminal 60 connected to a current sensing means, such as resistor 62 and diode 64. This will permit feedback to the engine controller unit with respect to the current through the output secondary winding 30.

In FIG. 2, the voltage regulator circuit, shown as functional group 12 in FIG. 1, includes a switch regulator integrated circuit 66, switching transistor 68, energy storage inductor 70, input filter capacitor 72 and output filter capacitor 74. The circuit provides a regulated voltage to the inverter in the range of 15 to 50 volts, depending on the integrated circuit 66 chosen and the ratio of feedback resisters 76 and 78. An input 80 may be provided for reducing the regulated voltage with a proportional positive voltage. The amount of the reduction may be controlled by adjusting the value of resistor 82. A control input 84 is provided to put the switching regulator 66 into an idle mode through the action of pull down transistor 86. The primary power inlet 88 from the battery is protected from load dump surges and spikes by a surge absorbing diode 90.

In the present invention, it would be preferable that the voltage from the battery be boosted so that the 5 to 15 volts from the battery turns into 35 to 50 volts for the oscillator. This would reduce the need for a high turns ratio in the transformer 22. As such, with such increase in voltage, the size of the transformer 22 can be suitably reduced.

Figure 3:
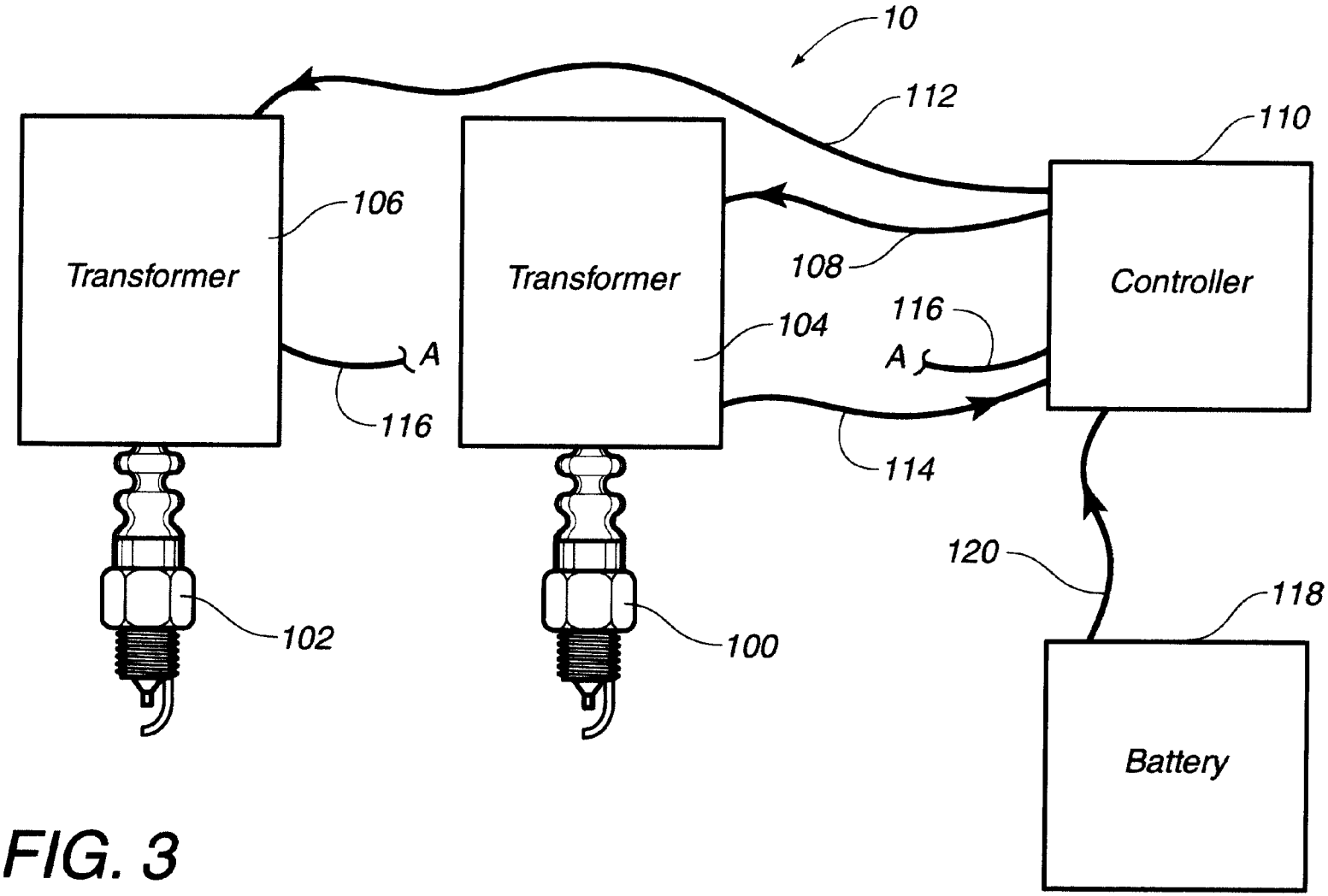
FIG. 3 is a block diagram showing the application of the system of the present invention to the spark plugs of a motor vehicle.

FIG. 3 is a diagrammatic illustration showing the ignition system 10 of the present invention as directly used in association with spark plugs 100 and 102. In FIG. 3, it can be seen that transformer 104 is directly connected onto the spark plug 100. Similarly, the transformer 106 is directly connected onto spark plug 102. An electrical line 108 will extend from the controller 110 to the transformer 104. Another electrical line 112 will extend from the controller 110 to the transformer 106. As such, the controller 110 can provide the necessary timing signals to the transformers 104 and 106 for the firing of spark plugs 100 and 102, respectively.

Similarly, the transformer 104 includes a sensor line 114 extending back to the controller 100. The transformer 106 also includes a sensor line 116 extending back to the controller 110. As such, controller 110 can receive suitable signals from the transformers 104 and 106 as to the operating conditions of the spark plugs 100 and 102 for a proper monitoring of the output current and output voltage of the secondary winding. By providing this information, the controller 110 can be suitably programmed to optimize the firing of the spark plugs 100 and 102 in relation to items such as engine temperature and fuel combustion. The automotive battery 118 is connected by line 120 so as to provide power to the controller 110.

As can be seen in FIG. 3, unlike conventional ignition coils, the firing of each of the spark plugs 100 and 102 is carried out directly on the spark plugs. The controller 110 can be a microprocessor which is programmed with the necessary information for the optimization of the firing of each of the spark plugs. The controller 110 can receive inputs from the crankshaft or from the engine as to the specific time at which the firing of the combustion chamber of each of the spark plugs 100 and 102 is necessary. Since each of the transformers 104 and 106 are located directly on the spark plugs 100 and 102, and since they operate at high frequencies, radio interference within the automobile is effectively avoided. Suitable shielding should be applied to each of the transformers 104 and 106 to further guard against any RF interference.

Within the system of the present invention, the twelve volt input is nominally the voltage of battery 118. This can vary from six volts at cold cranking to 14.5 or 15 volts during normal operation. The output voltage and energy of the high voltage transformer is proportional to the input voltage. As such, it is necessary to provide enough voltage and energy with six volts of input to start the vehicle during low voltage conditions, such as cold starting. Consequently, it is necessary to modify the circuit to operate at 30 kilovolts from the transformers with six volts of input. As such, the present invention can utilize a zener circuit, or similar circuit, across the input voltage so as to limit the input voltage to six volts.

The signal to the spark plugs is a low voltage square wave that turns the circuit on when the spark should fire and off when the engine does not require a spark. This can be varied so as to provide longer "arc duration" during cold starting and shorter during normal operation.

The circuitry of the present invention can utilize a filter to block RF frequencies from the DC power supply. This can be a small ferrite toroid and a filter capacitor.

The resonant oscillator used in the present invention, together with the primary winding of the transformer, forms an oscillator with the winding 32 during one half cycle of the sine wave output and with winding 37 during the other half of the sine wave output. Suitable capacitors can be used so as to set the oscillation frequency, along with the primary inductance and the secondary leakage inductance.

The output of the transformer 22 is a high voltage sine wave that reaches at least 20 kilovolts (zero to peak). The preferred frequency is in the range of 20 KHz.

The transformer 22 can take various shapes. One preferred type of transformer 22 would include a ferrite core (gapped in the center leg), a primary winding having eight turns center tapped of 18 gauge magnet wire, and a section bobbin secondary having approximately 10,000 turns of 40 gauge magnet wire. The transformer 22 can be potted in a high voltage potting material. The circuit associated with the transformer can be potted in the same shielded enclosure. The entire device can be approximately the size of a pack of cigarettes.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

What is claimed is:

1. An ignition system for an internal combustion engine comprising:

a transformer means having a primary winding adapted to be connected to a power supply, said transformer means having a secondary winding, said transformer means for producing an alternating current output from said secondary winding having a frequency of between 1 KHz and 100 KHz and a voltage of at least 20 kilovolts;

a connector extending from said secondary winding of said transformer means and adapted so as to connect with a terminal of a spark plug of the internal combustion engine; and a controller interconnected to said transformer means so as to activate and deactivate said output of said transformer means.

2. The system of claim 1, said output having a high voltage sine wave reaching at least 20 kilovolts.

3. The system of claim 1, further comprising:

a voltage regulator connected to said transformer means so as to provide a constant DC voltage input to said transformer means.

4. The system of claim 1, said transformer means for producing power of constant wattage from said output of said secondary winding during an activation by said controller.

5. The system of claim 1, further comprising:

a spark plug connected to said connector of said transformer means, said controller connected to said output of said secondary winding of said transformer means so as to produce an arc of controllable duration across an electrode of said spark plug, said duration being selected from 0.5 milliseconds and 4.0 milliseconds.

6. The system of claim 1, further comprising:

a battery interconnected to said primary winding of said transformer means, said battery producing a voltage of between 5 and 15 volts.

7. The system of claim 1, said secondary winding comprising:

an output secondary winding having said connector extending therefrom, said output secondary winding having a current sensor attached thereto and connected to said controller so as to sense current through said output secondary winding; and a sensing secondary winding connected to said controller so as to sense a voltage of said output of said transformer means.

8. The system of claim 1, said transformer means comprising:

an inverter means for converting said output to an alternating current.

9. The system of claim 8, said voltage regulator means comprising:

a switch regulator integrated circuit connected to an energy storage inductor and to a switching transistor, said switch regulator integrated circuit receiving a variable voltage from the power supply, said switch regulator integrated circuit passing a fixed voltage of between 5 and 50 volts to said transformer means.

10. The system of claim 3, further comprising:

a voltage input means connected to said switch regulator integrated circuit for reducing said fixed voltage with a proportional positive voltage.

11. The system of claim 10, further comprising:

a spark plug having said connector affixed thereto, said transformer means being affixed directly over said spark plug, said transformer means having an electrical line extending to said controller mounted at a location away from said spark plug; and a battery having a power supply line extending to said controller, said controller passing a fixed voltage from said power supply line of said battery to said transformer means.

12. The system of claim 1, said controller being a microprocessor.

13. An ignition system for an internal combustion engine comprising:

a transformer means having a primary winding adapted to be connected to a power supply, said transformer means having a secondary winding, said transformer means for producing an alternating current output from said secondary winding having a frequency of between 1 KHz and 100 KHz and a voltage of at least 20 kilovolts, said transformer means comprising a current fed Royer-oscillator connected to said primary winding;

a connector extending from said secondary winding of said transformer means and adapted so as to connect with a terminal of a spark plug of the internal combustion engine; and a controller interconnected to said transformer mean so as to activate and deactivate said output of said transformer means.

14. An ignition system for an internal combustion engine comprising:

a transformer means having a primary winding adapted to be connected to a power supply, said transformer means having a secondary winding, said transformer means for producing an output from a secondary winding being of an alternating current having a frequency of between 1 KHz and 100 KHz;

a single spark plug connected to said secondary winding of said transformer means; and a controller interconnected to said transformer means so as to place said transformer means in an active state and in an inactive state, said transformer means passing said current to said single spark plug in said active state.

15. The system of claim 14, said alternating current having a high voltage sine wave reaching at least 20 kilovolts.

16. The system of claim 14, said transformer means passing power to said single spark plug of a constant wattage during said active state.

17. The system of claim 14, further comprising:

voltage regulator means connected to said primary winding of said transformer means, said voltage regulator means for passing a constant DC voltage input to said transformer means of between 5 and 50 volts.

18. The system of claim 17, further comprising:

a battery electrically connected to said voltage regulator means so as to pass a variable voltage of between 5 and 15 volts to said voltage regulator means.

19. The system of claim 14, said controller having an active state corresponding to a duration of an arc across an electrode of said spark plug, said duration being between 0.5 milliseconds and 4.0 milliseconds.

20. An ignition system for an internal combustion engine comprising:

a battery;

a voltage regulator connected to said battery and adapted to pass a constant DC voltage as an output therefrom;

a plurality of transformers, each having a primary winding and a secondary winding, said primary winding connected to said voltage regulator so as to receive said constant DC voltage therefrom; and a spark plug connected to said secondary winding of each of said plurality of transformers, each of said plurality of transformers for a passing power of constant wattage to said spark plug.

21. The system of claim 20, said each of said plurality of transformers for converting said constant DC voltage into an alternating current having a frequency of between 1 KHz and 100 KHz, said alternating current having a high voltage sine wave reaching at least 20 kilovolts.

22. The system of claim 20, said battery passing a variable voltage to said voltage regulator of between 5 and 15 volts, said constant DC voltage between 5 and 50 volts.

23. The system of claim 20, further comprising:

a controller means connected to said plurality of transformers, said controller means for placing said spark plug in an active state and in an inactive state.

24. The system of claim 23, said active state corresponding to a duration of an arc across an electrode of said spark plug, said duration being between 0.5 milliseconds and 4.0 milliseconds.

25. The system of claim 20, said each of said plurality of transformers being mounted directly onto said spark plug.

26. An ignition system for an internal combustion engine comprising:

a transformer means having a primary winding adapted to be connected to a power supply, said transformer means having a secondary winding;

a spark plug connected to said secondary winding of said transformer means, said spark plug having an electrode formed thereon so as to allow a spark to pass therefrom, said transformer means for passing voltage of a least 20 kilovolts to said spark plug, said voltage passed to said spark plug by said transformer means being an alternating current of between 1 KHz and 100 KHz; and a controller connected to said transformer means, said controller for placing said transformer means in an active state and in an inactive state, said active state corresponding to a duration of the spark across said electrode, said duration being between 0.5 milliseconds and 4.0 milliseconds.

27. The system of claim 26, said duration of said spark being selectively set by said controller relative to a condition of the internal combustion engine.

28. The system of claim 26, said alternating current having a high voltage sine wave of at least 20 kilovolts.

29. The system of claim 28, further comprising:

a battery passing a variable voltage of between 5 and 50 volts; and a voltage regulator means connected to said battery and to said primary winding of said transformer means, said voltage regulator means for passing a constant DC voltage of between 5 and 50 volts to said transformer means.

* * * * *